United States Patent [19]

Beckert et al.

[11] 4,000,022

[45] Dec. 28, 1976

[54] FAST-BURNING COMPOSITIONS OF FLUORINATED POLYMERS AND METAL POWDERS

[75] Inventors: Werner F. Beckert, Las Vegas, Nev.; Ottmar H. Dengel, Front Royal, Va.

[73] Assignee: The United States of America as represented by the Secretary of the Navy, Washington, D.C.

[22] Filed: Oct. 17, 1974

[21] Appl. No.: 515,772

[52] U.S. Cl. ..... 149/19.3; 149/37

[51] Int. Cl.[2] ..... C06B 45/10; C06B 33/00

[58] Field of Search ..... 149/19.3, 37, 17, 19.9, 149/19.91, 44, 42

[56] References Cited

UNITED STATES PATENTS

| | | | |
|---|---|---|---|
| 2,953,443 | 9/1960 | Lloyd | 149/37 |
| 3,160,537 | 12/1964 | Trafton | 149/37 |
| 3,163,113 | 12/1964 | Davis | 149/37 |
| 3,203,171 | 8/1965 | Burke | 149/19.3 |
| 3,297,503 | 1/1967 | Hoffmann | 149/37 |
| 3,309,249 | 3/1967 | Allen | 149/37 |
| 3,503,814 | 3/1970 | Helms | 149/37 |
| 3,565,706 | 2/1971 | Waite | 149/37 |
| 3,669,020 | 6/1972 | Waite | 149/19.3 |
| 3,695,951 | 10/1972 | Helms | 149/37 |
| 3,726,727 | 4/1973 | Ishibashi | 149/37 |
| 3,745,077 | 7/1973 | Jones | 149/17 |
| 3,890,174 | 6/1975 | Helms | 149/37 |

OTHER PUBLICATIONS

Taylor, Solid Propellent and Exothermic Compositions (1959), pp. 7, 135–146.

*Primary Examiner*—Samuel W. Engle
*Assistant Examiner*—Donald P. Walsh

[57] ABSTRACT

Flammable, relatively fast-burning compositions of fuels and oxidizers, which ignite and burn readily, forming substantially non-gaseous residues. The compositions comprise certain oxygen- or fluorine-rich compounds such as perchlorates, nitrates, oxides and polytetrafluoroethylene, and certain fuels such as metal powders and metal sulfides.

1 Claim, No Drawings

FAST-BURNING COMPOSITIONS OF FLUORINATED POLYMERS AND METAL POWDERS

BACKGROUND OF THE INVENTION

This invention relates to flammable compositions and more particularly to flammable compositions which include a fuel and an oxidizer, burn relatively fast, and form substantially non-gaseous residues.

A major application of flammable compositions is as a military weapon both against personnel and material. Materials, such as communication equipment and supplies are ignited by flammable compositions and rendered useless. Even heavy weapons such as tanks and artillery can be successfully attacked with flammable compositions due to the possible ignition of fuel and ammunition, destruction of sensitive essential parts and even volatilization or decomposition of lubricants.

In order for a flammable composition to be highly effective in use against personnel, it must meet the following criteria:

a. A large number of burning particles must be densely distributed over the target area to increase the probability of multiple hits;
b. The burning time of the particles should not be more than approximately 10 seconds, the estimated maximum time span for the burning particles to be removed from the targets;
c. The particles must be easily ignitable; and
d. The caloric output and thus the temperature of the burning particles must be as high as possible, which implies that the reaction products must not be gases in order to minimize heat losses.

Currently used flammable compositions which are used as military weapons are gelled flammable liquids. Gelling agents (and sometimes ignition materials) are mixed with gasoline or similar readily combustible liquids or solutions to form one suitable flammable composition. A generic term for such flammable materials is Nepalm.

For maximum efficiency against material, the Napalm gel, after impact, must break up into globules with burning times of up to 15 minutes. The huge fireballs which form initially upon impact from the combustion of finely divided gel look quite impressive but are, in themselves, rather ineffective.

Nepalm gels are highly effective against materials, but when Napalm gels are used as anti-personnel weapons the gels are less effective because the burning globules, reaching temperatures between 900° and 1000° C will in most cases be removed by the attacked personnel from their bodies and clothes within 10 seconds or less, thus sustaining only superficial burns which require minimum medical attention. As a result, close to 99% of the chemical energy contained in the Napalm globules with their burning time of approximately 15 minutes is wasted.

Napalm-type flammable materials do not contain any oxidizers, their combustion depends solely on oxygen from the ambient air. When the oxygen in the immediate vicinity of the burning globules is consumed, fresh air has to move in to continue to support combustion. This, combined with the fact that combustion under these conditions can occur only at the surface of the globules, accounts for the long burning time. The combustion products are gases which, together with the simultaneously heated nitrogen of the air, remove a substantial part of the combustion heat from the target; this accounts for the relatively low, burning temperature.

Thus, the long burning time of Napalm-type material, combined with heat removal by the gaseous of the combustion products show clearly that Napalm does not meet all of the desired criteria for flammable compositions to be used as anti-personnel weapons.

SUMMARY OF THE INVENTION

It is, therefore an object of this invention to provide flammable compositions having short burning times.

Also it is an object of this invention to provide flammable compositions having high caloric outputs.

It is a further object of this invention to provide flammable compositions wherein the reaction products formed upon ignition are essentially non-gaseous.

It is a still further object of this invention to provide flammable compositions which disperse into large numbers of burning particles.

Another object of this invention is to provide flammable compositions which disperse into easily ignitable particles.

These and other objects of the invention are met by providing flammable compositions comprising essentially stoichiometric mixtures of oxidizers and fuels, while stoichiometric excesses of one or more of the ingredients are also acceptable.

DESCRIPTION OF THE PREFERRED EMBODIMENTS

An oxidizer and a fuel form a flammable composition the combustion of which does not depend on oxygen from the surrounding air and which has therefore wide application in the military arts or other appropriate fields. Additives to those compositions such as a metal powder are optional as is a small percentage of a binder.

An appropriate oxidizer is a compound or composition capable of supplying oxygen or other oxidizing agents, such as fluorine to the reaction. One or more oxidizers are suitable in the flammable composition. Specific examples of oxidizers include oxides (e.g., molybdenum trioxide, titanium dioxide, manganese dioxide, cupric oxide, nickel oxide, and others), nitrates, chromates, perchlorates, permanganates, sulfates, highly fluorinated organic compounds, such as polytetrafluoroethylene, and others. Combinations of oxidizers can be used, as well as eutectic mixtures, e.g., lithium perchlorate/sodium perchlorate, sodium nitrate/potassium nitrate, and others. Other suitable oxidizers and oxidizer properties include those listed in U.S. Pat. No. 3,770,524 to Walker et al., said patent being incorporated herein by reference. Especially suitable oxidizers include sodium perchlorate, potassium perchlorate, magnesium perchlorate, vanadium pentoxide, and polytetrafluoroethylene. The oxidizer is required to be in the compositions in order to achieve the desired burning time of within about 10 seconds. Suitable oxidizer percentages based on the weight of the flammable composition range from about 30 to 65%. Various ranges within the broad ranges are appropriate depending on the other materials present.

A fuel suitable for the flammable composition is usually in the powdered form as is the oxidizer. One or more fuels are used in the flammable composition at the same time. Fuels are generally metallic in nature such as elements like titanium, zirconium, beryllium, or antimony. Especially suitable fuels besides those previously named include aluminum, iron, and magnesium. Compounds such as sulfides also provide suitable fuels. Other suitable fuels and fuel properties are listed in the above referenced patent. The percentage of fuel ranges from 20 to 60% by weight of composition depending on the other components.

The flammable composition improves with respect to processibility and mechanical properties by the addition of a binder. A styrene/isoprene copolymer is suitable as a binder because it dissolves in solvents such as toluene and blends well in solution with the other components of the flammable composition. After blending, the toluene solvent is evaporated and the binder is thus incorporated in the flammable composition. Nitrocellulose is also a suitable binder because it dissolves in a suitable solvent such as butyl acetate and blends well with the other components of the flammable composition. Other soluble binders are also suitable such as those disclosed in U.S. Pat. No. 3,051,662 to Pitzer et al, and U.S. Pat. No. 3,657,027 to Horsey et al, both of said patents being incorporated herein by reference. Additional suitable binders include other hydrocarbon binders such as carboxy-terminated polybutadiene, or fluorinated polymers such as Viton$^R$. The binder is usually present in the composition from 0% to about 10% depending on the composition.

Other additives may also be incorporated in the flammable composition. Additional metal powder beyond that required as the fuel is optionally included in the flammable composition. The additional metal powder may be the same as or different than the fuel. Its purpose is to remain, after combustion of the oxidizer/fuel part, as an extremely hot regulus on the target. Glass powder may also be added to the formulation in order to increase adherence to the target.

The above-referenced formulations are shapeable (e.g., into pellets) for inclusion in various delivery means. The burning times of the pellets can be varied according to specific requirements by modifying the formulations and/or particle sizes of the ingredients. The disclosed formulations can easily be scaled up to production levels by using conventional methods (e.g., extrusion). The pellets can be delivered in appropriately shaped and fused containers by plane, rocket, and artillery or mortar shells; even hand grenades, rifle grenades or hand-held dispensers for close range situations could be used. In addition, use in anti-personnel mines is feasible.

The pellets can optionally be at least partially coated in order to facilitate ignition. A suitable coating formulation is a mixture of boron, barium chromate, glass powder, and nitrocellulose. Mixtures similar to the coating mixture described above are easily ignited by the flash of a black powder charge or similar means.

Other coatings can be used, such as a mixture of vanadium oxide, aluminum powder, and a binder, or others. The coating could also consist of a material which ignites on contact with air. Examples of materials which ignite on contact with air are white phosphorus, phosphorus sesquisulfide, a number of organo-metallic compounds, and others.

All references to powder include particles up to about 500 microns in diameter.

The following examples are intended to illustrate without unduly limiting the invention. All parts and percentages are by weight of the total composition unless otherwise specified.

EXAMPLE I

Nitrocellulose dissolved in butyl acetate is mixed with the other components in a standard process. The solvent is evaporated and the resulting solid precipitate ground and pressed into pellets weighing between 1 and 2 grams. The resulting pellets are composed of 50 to 60% sodium perchlorate as an oxidizer;
29 to 35% aluminum powder as a fuel;
4 to 6% nitrocellulose as a binder;
6 to 9% glass powder, to improve adherence to the target.

Upon touching the pellet with the tip of a small propane flame, the pellet ignites in a fraction of a second which illustrates easy ignitability, and completely burns in less than 10 seconds. The calculated heat of reaction of about 2.7 kilocalories per gram is at least 50% above that of a prior art composition. Damage caused to the surface of a wood support is substantial due to the formation of a solid hot residue.

EXAMPLE II

The procedure of Example I is repeated with equivalent results using the following compositions:

potassium perchlorate: 43% to 65%;
Aluminum powder: 22% to 33%;
iron powder: 2% to 28%;
nitrocellulose: 1.5% to 2.5%;
glass powder: 0% to 9%.

EXAMPLE III

The procedure of Example I is repeated with equivalent results using the following composition:

potassium perchlorate: 33% to 36%;
iron powder: 55% to 62%;
nitrocellulose: 2% to 2.5%;
glass powder: 0% to 9%.

EXAMPLE IV

The procedure of Example I is repeated with equivalent results using the following composition:

vanadium pentoxide: 45% to 50%;
aluminum powder: 20% to 25%;
iron powder: 25% to 30%;
nitrocellulose: 2% to 3%.

EXAMPLE V

The procedure of Example I is repeated with equivalent results using the following composition:

polytetrafluoroethylene: 45% to 56%;
magnesium powder: 22% to 28%;
iron powder: 12% to 26%;
nitrocellulose: 1.5% to 2.5%;
glass powder: 0% to 8%.

EXAMPLE VI

The procedure of Example I is repeated with equivalent results using the following composition:

polytetrafluoroethylene: 25% to 30%;
magnesium powder: 10% to 15%;
Pyronol: 40% to 55%;
nitrocellulose: 1.5% to 2.5%;
glass powder: 0% to 15%.

Pyronol is a pyrotechnic composition comprising 35% $Fe_2O_3$, 28% Al, 32% Ni, 5% polytetrafluoroethylene, all percentages in this instance being based on the weight of Pyronol.

EXAMPLE VII

The procedure of Example I is repeated with equivalent results using a composition comprising:

magnesium perchlorate: 20% to 35%;
polytetrafluoroethylene: 48% to 53%;
magnesium powder: 23% to 26%;
nitrocellulose: 2% to 3%.

EXAMPLE VIII

The procedure of Example I is repeated with equivalent results using a composition comprising:

Pyronol: 78% to 81%;
nitrocellulose: 5% to 7%;
glass powder: 12% to 15%.

EXAMPLE IX

Example I–VIII are repeated using a styrene/isoprene copolymer as the binder with equivalent results being obtained.

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. A flame producing composition consisting essentially of the intimate mixture in the solid state of an oxidizer and a fuel wherein the oxidizer is present in the range from 30 to 65 percent and the fuel is present in the range from 20 to 60 percent, all percentages being based on the total weight of the composition; and wherein the oxidizer is polytetrafluoroethylene and the fuel is a mixture of Mg and Fe.

* * * * *